United States Patent [19]

Kauffman et al.

[11] 4,173,386

[45] Nov. 6, 1979

[54] COAXIAL ASSEMBLY

[75] Inventors: Roger S. Kauffman, Newark; Donald L. Slothour, Wilmington, both of Del.

[73] Assignee: W. L. Gore & Associates, Inc., Newark, Del.

[21] Appl. No.: 882,185

[22] Filed: Mar. 13, 1978

[51] Int. Cl.[2] ..... H01R 17/08

[52] U.S. Cl. ..... 339/177 R; 174/87

[58] Field of Search ..... 339/177 R, 177 E, 178; 174/75 C, 87, 88 C

[56] References Cited

U.S. PATENT DOCUMENTS

| | | | |
|---|---|---|---|
| 1,914,011 | 6/1933 | Eccles | 174/87 |
| 2,356,053 | 8/1944 | Hastings, Jr. et al. | 339/177 E |
| 2,933,714 | 4/1960 | Overholster | 339/177 R |
| 3,480,722 | 11/1969 | Van Horssen et al. | 339/177 E |

FOREIGN PATENT DOCUMENTS

| | | | |
|---|---|---|---|
| 2534111 | 2/1977 | Fed. Rep. of Germany | 339/177 R |
| 234502 | 5/1969 | U.S.S.R. | 339/177 E |

*Primary Examiner*—Neil Abrams

*Attorney, Agent, or Firm*—John S. Campbell

[57] ABSTRACT

An angled coaxial connector capable of being split into at least two parts in such a manner that the terminal portion of a coaxial cable can be placed between the two of the connector parts spanning the curved portion and termination proximate to the mating end of the connector. The resulting coaxial assembly provides a means of transmitting microwave signals through a change in direction with only one discontinuity.

17 Claims, 5 Drawing Figures

COAXIAL ASSEMBLY

FIELD OF INVENTION

The present invention relates to a connector for use in coaxial assemblies, to coaxial assemblies, and to a method of forming coaxial assemblies. Coaxial assemblies are used in the efficient transmission of high frequency electromagnetic energy.

Coaxial assemblies are often critical components in the transmission of radio frequency signals in radar, electronic countermeasure radio relay and telecommunication systems and are becoming increasingly vital for pulse signal transmission in high speed data processing equipment. For such uses the electrical efficiency and uniformity of the assembly must be maintained over a broad range of frequencies and in a variety of installations and environments.

As referred to herein, a coaxial assembly comprises a coaxial cable along with at least one connector required to connect the coaxial cable to an apparatus for receipt of, or further transmission of, the signals.

A connector in the simplest terms is a device used to provide rapid, efficient, connect/disconnect service for electrical wire and cable termination.

A coaxial cable comprises a center conductor of circular cross-section along with a concentric insulating dielectric contained within a cylindrical outer conductor which in turn is sometimes covered by an outside jacket of a suitable insulating material. The center conductor is centered by the dielectric. The dielectric may be comprised of beads or continuous solid or semi-solid insulating medium. The cylindrical outer conductor may be a continuous tube, or the coaxial cable can conventionally be made flexible (as opposed to rigid or semi-rigid in the former) by constructing a flexible outer conductor such as a served wire or foil shield or fine wire braid, or a combination thereof.

The dielectric constant of air is 1.0, and this is the standard to which the dielectric constant of all other insulation materials is compared. In coaxial cables and assemblies it is very desirable to have an insulating medium whose dielectric constant is as close to 1.0 as possible.

In the early 1970's, a new form of polytetrafluoroethylene (PTFE) became available. This expanded, microporous PTFE has a microstructure comprising solid nodes interconnected by fibrils, and can be made with greater than 90% porosity (air volume). A process for manufacturing this material is described in U.S. Pat. No. 3,953,566, assigned to W. L. Gore & Associates, Inc., Newark, Del. The expanded PTFE is marketed under the trademark GORE-TEX.

Expanded microporous PTFE is a very desirable insulating medium. As a result of its high air content, its dielectric constant can be as low as about 1.25—closer to the standard of 1.0 than any known solid dielectric material. Expanded microporous PTFE retains all the well-known desirable properties of PTFE; high chemical resistance, use in a wide range of temperatures and non-wettability and yet allows the construction of an extremely efficient cable due to its low dielectric constant.

Utilizing this new form of polytetrafluoroethylene, a line of lightweight, flexible coaxial cables has been developed. These new coaxial cables have lower capacitance and much lower loss than conventional PTFE insulated coaxial cables of similar size. Signal speeds and corona initiation voltages are increased. In addition to improved electrical characteristics, these new coaxial cables are especially advantageous in applications where flexibility and electrical performance in excess of that provided by semi-rigid cables is a requirement.

In order to take full advantage of this unique cable, there must be connectors which will allow it to be connected to other apparatus without seriously impairing the exceptional electrical characteristics of the cable.

As stated in U.S. Pat. No. 3,336,563, among the features desirable in a coaxial electrical connector are (a) electrical characteristics which are not only constant from connector to connector, such that the coaxial connector introduces the least possible discontinuity to the propagation of electrical signals therethrough, and (b) construction features which not only simplify the installation of the connector to a coaxial cable but also result in uniform and adequate mechanical strength. The electrical characteristics of a coaxial connector are intimately related to its mechanical construction.

U.S. Pat. No. 3,336,563 is concerned with achieving these properties in a straight connector. In many installations, space and/or routing dictate the use of angled, particularly right-angled connectors.

The term angled connector, as herein used, connotes a curved bend or turn through an appreciable angle, in the path of energy transmission, which angle is often a right angle, but may be more or less than a right angle.

Previous angled connectors have been termed adapters. An adapter is defined herein as an angled device which connects the coaxial cable to an apparatus and is characterized by the cable being attached to one end of the adapter and the apparatus being attached to the other end. The electromagnetic energy is transmitted through the adapter by pre-fabricated parts and no component of the cable passes through the adapter.

In the adapters of the prior art, the outer conductor and the inner conductor, often termed the center probe, for the best electronic effects, are required to be accurately concentric within an extremely close tolerance. A solid plastic material consisting of a tetrafluoroethylene polymer manufactured and sold by DuPont, Wilmington, Del., under the trademark TEFLON is commonly used to maintain the center probe accurately in place.

These adapters of the prior art, are separate from, and not integral extensions of the center conductor, insulating medium and outer conductor of the coaxial cable. The only practical way for placing the center probe into the outer conductor of the adapter of the prior art is to divide the outer conductor and the Teflon insulator into two miter-fitted parts that are introduced from opposite ends of the adapter, abutted, and said abutted joint brazed, soldered, or welded. In order to obtain the required accuracy such parts must necessarily be carefully prepared and designed for accurate interfit. The foregoing adapter, even if satisfactory in use, is very expensive to produce and is subject to mechanical failure at the abutted joint.

Accurate concentricity cannot be maintained between the probe and the outer conductor through a mitered joint. Therefore, there is of necessity an abrupt change in the electrical field configuration at this mitered joint which causes an impedance mismatch. Energy reflections are created, which if ignored, result in loss of transmission energy.

Another problem which may become serious at high voltages and high frequencies results from voltage stress concentrations, at the mitered joint corners, promoting breakdown. Additionally, a mechanical problem is presented in forming the mitered joint without a gap or crack between the two mitered TEFLON insulators. Such a gap would produce stress concentration and be subject to voltage breakdown.

The disclosure of U.S. Pat. No. 2,933,714 sought to overcome the problems outlined above by utilizing a coaxial adapter in which both the center probe and its encompassing insulator are single and continuously formed elements maintained in proper concentricity within an elbow. Although, representing an improvement over the prior art, the structure taught by U.S. Pat. No. 2,933,714 does not overcome the problem of connections at each end of the adapter and, therefore, two discontinuities.

Another attempt to overcome the problem of the mitered connection is disclosed in U.S. Pat. No. 2,952,823. The objective of the latter patent is to provide an adapter which requires no soldering or similar joining of current-carrying elements and which is readily disassembled to permit inspection of the insulation. This is accomplished by constructing a tubular conductive shell of rigid elbow form which constitutes the outer conductor of the fitting. This shell is formed from two complimentary parts which are separable along a parting plane containing the longitudinal axis of the elbow. The detachable parts are held together at the ends by removable collars. An elongated inner conductor in the same elbow-form as the outer conductor is maintained centered in the outer conductor by a body of insulation occupying the annular space therebetween.

The latter connector also requires two connections and, therefore, two discontinuities and is awkward to assemble.

It is, therefore, an objective of the present invention to provide a coaxial assembly with a connector which gives rise to only one discontinuity.

It is still a further objective of this invention to provide a coaxial assembly with an angled connector which closely approaches the performance of a coaxial assembly with a straight connector.

These and other features, objectives and advantages of the present invention will become more fully evident from the detailed description herein contained. This description refers to the best mode known to the inventors at the time of filing of this application. The description is illustrative and is, of course, subject to modification without departing from the spirit or scope of the invention. It is, therefore, not desired to restrict the invention to the particular assembly illustrated, but to cover all modifications that may fall within the scope of the appended claims. In particular, it is expressly intended that the bend angle of the connector may be varied and also that the lineal length over which the selected angle is formed may be changed.

DETAILED DESCRIPTION OF THE INVENTION AND DRAWINGS

The connector of the coaxial assembly, in accordance with the invention, includes a tubular connector, separable into a body and a cap, for the transmission of electrical energy therethrough. The connector body includes conductive means for electrically connecting a cylindrical shield to the apparatus.

Figure 2:
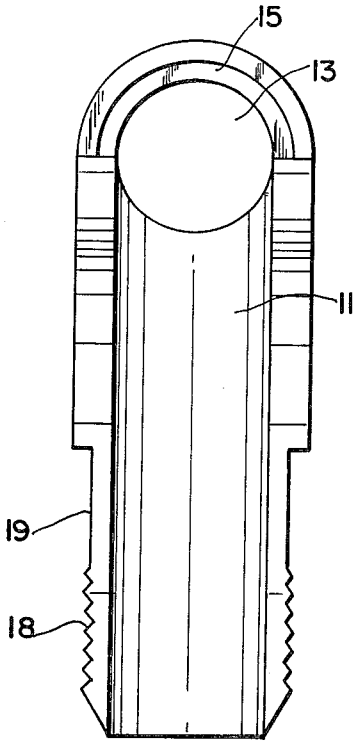
FIG. 2 is a front view of the body of the shell of FIG. 1.
Figure 1:
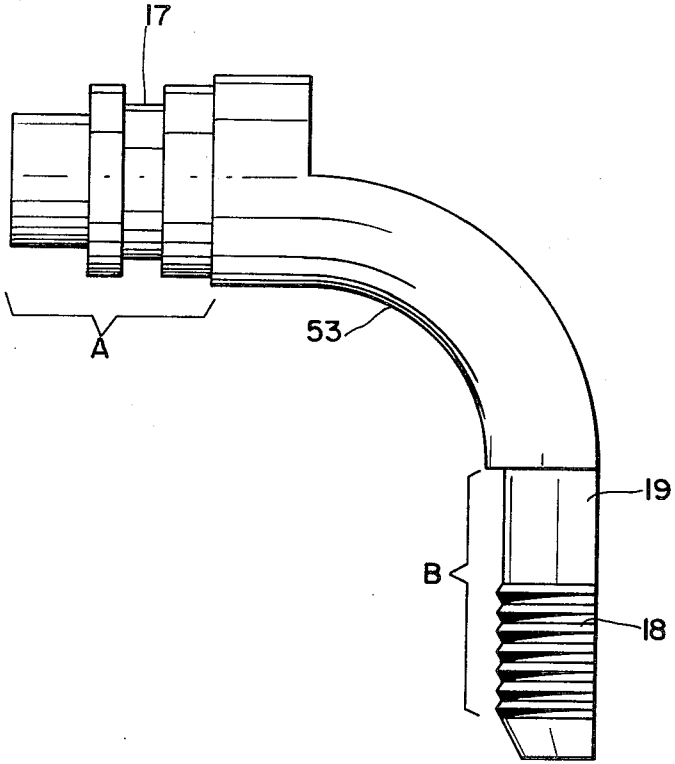
FIG. 1 is a side view of the body of the conductive tubular shell of the coaxial assembly of the invention.

FIGS. 1 and 2 show the body of the tubular connector of the invention. To enable the coaxial assembly to be more readily understood, the two ends of the body 53 of the tubular connector, generally referred to as 10 (FIG. 5), have been labeled "A" and "B" in FIG. 1. End "A" is the device end of the assembly that is to be engaged to any electronic apparatus, by any variety of well-known means and will be referred to as the mating end. End "B" is the cable end at which the coaxial cable enters the connector body and will be generally referred to as the back end.

The body 53 is curved to form an angle at the intersection of the projections of the diameters of the ends A and B. In the Figures, this angle is shown as a right angle, but embodiments of this invention need not be so limited. The body 53 is constructed in such a way that the portion nearest the mating end has a tubular cross section 13 (illustrated in FIG. 2) and the remainder of the length of body 53 forms a semi-circular groove 11. As will be seen from FIG. 1 a portion 19 of the cable end of the body 53 has a reduced diameter, and the terminal portion 18 of reduced portion 19 has annular ribs. The circular portion 13 of body 53 has an inner semi-circular recess 15, the purpose of which will be more fully understood by reference to FIGS. 3 and 4. The mating end "A" is also provided with a well-known means 17 for connecting by conventional means such as a nut 59 and retaining c-ring 57 in FIG. 5, to other electronic apparatus.

The body includes conductive means for connecting a cylindrical shield to the apparatus. The material of the connector body 53 is preferably brass or stainless steel which may or may not be plated with, for example, gold or silver. Other materials and/or platings will be readily known to one skilled in the art.

Figure 3:
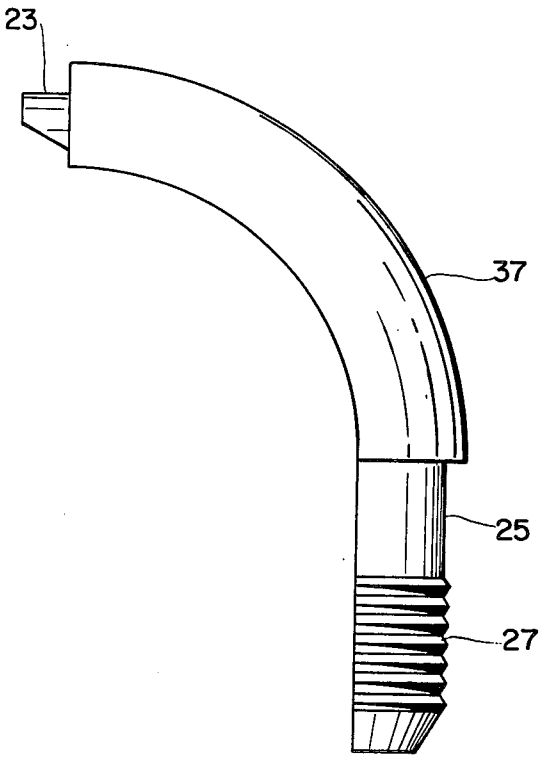
FIG. 3 is a front view of the cap for the conductive tubular shell of FIG. 1.
Figure 4:
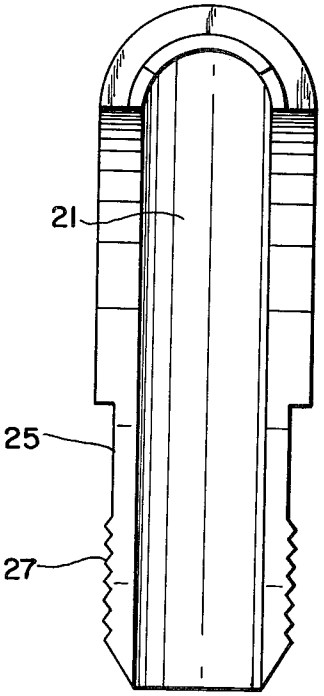
FIG. 4 is a side view of the cap of the conductive shell shown in FIG. 3.

FIGS. 3 and 4 show the cap 37 of the tubular connector. Cap 37 is formed to complete the tubular cross section of the connector in conjunction with body 53 and has a semi-circular groove 21 that extends along its entire length. In accordance with the invention, means are provided for joining said cap and said body to form said tubular connector after receipt of the body of the terminal portions of the cylindrical conductive sleeve, the insulating medium, and the center conductor. As here embodied, the joining means includes a tongue 23, formed on one end of cap 37, that telescopes into the semi-circular recess 15 in body 53. The cap also has at the back end a portion 25 of reduced diameter with annular ribs provided on its terminal part 27. It will be readily apparent that the body 53 and cap 37 of FIGS. 1 to 4 can be assembled by telescoping tongue 23 into recess 15 and aligning portion 19 on body 53 and portion 25 on cap 37 in abutting relationship to form an angled connector with a tubular cross section previously referred to as the tubular connector.

Figure 5:
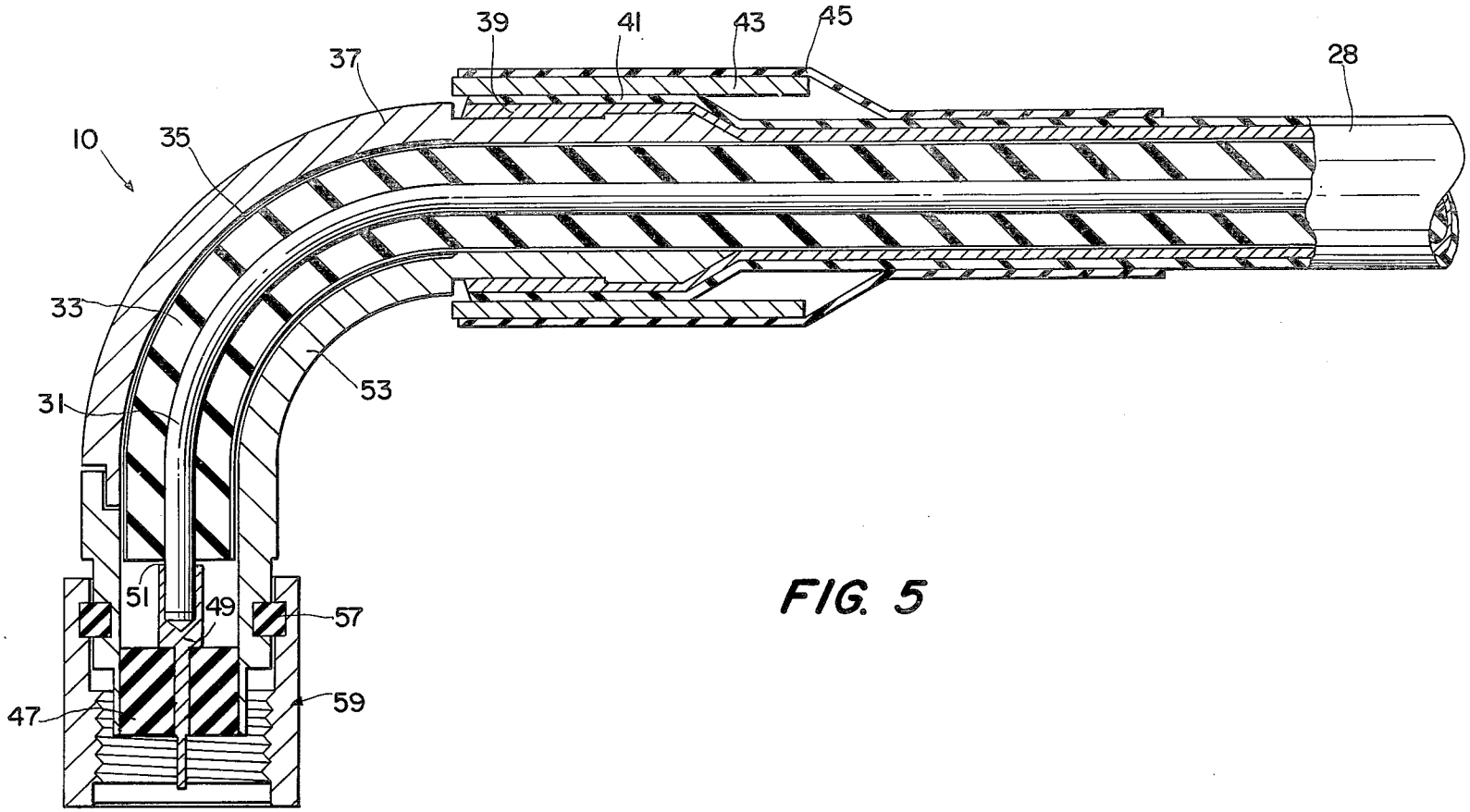
FIG. 5 is a cross-sectional view of the best embodiment of the invention known to the inventors at the time of filing this application.

FIG. 5 shows a cross section of the completed assembly. A center conductor 31, an insulating medium 33, and a served foil shield 35 comprising the terminal portion of the coaxial cable 28, are contained within the tubular space created when cap 37 and body 53 are combined. As used herein, a served foil shield refers to a metal foil which has been helically wrapped, with an overlap, around the insulating medium. Conductor 31, insulating medium 33, and foil shield 35 extend along almost the entire length of the tubular connector 10. The served foil shield is conductively attached to the body 53 at a location very close to the mating end. The center conductor 31, insulating medium 33 and served foil shield 35 thus extend through the angle of the angled connector (bent conductive tube) and can be terminated as close as possible to the point at which the cable assembly is engaged to other apparatus. As shown in FIG. 5 the engagement is accomplished by connecting the center conductor 31 to a short metal pin 49 which is supported in a block of dielectric material (usually Teflon) 47. An air gap 51 between the metal contact pin 49 and the insulating medium 33 is adjusted for the desired electrical characteristics of the assembly. The size of this gap would be readily calculable by one skilled in the art.

At the other or back end of the connector, the reduced diameter portion 25 of cap 37 and the reduced diameter portion 19 of body 53 are covered by a braided shield 39 and the outer jacket 41 of the coaxial cable. Affixing means are provided for affixing the coaxial cable to the tubular connector, as herein embodied. The affixing means includes a crimped tube 43 that provides stress relief and conventionally encompasses jacket 41 and an outer shrink tube 45 which is applied as protection against moisture, the environment, and as an additional strain relief. Shrink tube 45 is preferably formed of a polyolefin material and when shrunk on crimped tube 43 and the adjacent portion of outer jacket 41 helps maintain the longitudinal alignment of the parts of the back end of the assembly.

The present invention will be better understood by a description of the best mode of attaching the coaxial cable to the connector of the invention, known to the applicants at the time of filing this application. This mode is as follows: remove the outer jacket 41 and braided shield 39 from the end of a coaxial cable for a length sufficient to allow the inner served foil shield 35 to lie within and contact the semi-circular trough 11 of the body portion 53 of the connector. A further approximately ½ portion of the jacket 41 is slit in three places 120° apart. Fold this portion back on the main portion of the jacket, comb out the exposed braided wires 39 and fold them back over the slit and folded portions of the jacket. Tin the exposed lower portion of the served foil shield 35 by applying a coat of solder and strip the served foil shield 35 and insulating medium 33 to expose a sufficient length of center conductor 31 to permit the contact pin 49 to be attached. The contact pin 49 is attached to center conductor 31 by a conductive means, for example, by soldering. Care is taken to ensure that the appropriate gap 51, for the desired electrical characteristics, exists between the center pin 49 and the end face of the insulating medium 33. Slip the shrink tube 45 and crimp tube 43 over the cable and slide them back up the cable out of the way.

With the small Teflon insert 47 installed in body 53 at the mating end, insert the prepared portion of the cable, with the contact pin 49 attached, into the circular portion 13 of the body 53 taking great care to ensure that contact pin 49 is properly inserted in the Teflon insert. Gently, form the exposed insulating medium 33 and foil served shield 35 to the contours of the angled semi-circular trough 11. Conductively, attach the foil served shield 35 to body 53 at a location close to the mating end of body 53. This attachment is achieved, in the present case, by soldering. Telescope the tongue 23 of cap 37 into the recess 15 of body 53 and align and abut the reduced portion 19 and 25 of body 53 and cap 37, to form the completed conductive tubular shell around center conductor 31, insulating medium 33 and served wire shield 35 of the coaxial cable 28. Apply an environmental sealant, such as a silicone rubber, to the interface of the body and the cap for protection.

Fold the braided shield 39 and slitted portions of outside jacket 41 over the reduced diameter portions 19, 25 of body 53 and cap 37, and secure the braid and jacket in place with the crimp tube 43 and secure the shrink tube 45 over the crimp tube 43.

In the above described procedure, the preferred insulating medium 33 is a GORE-TEX expanded PTFE insulation. The invention, however, is equally applicable to other well-known insulating materials such as PTFE, polyethylene, polyester, FEP (a copolymer of tetrafluoroethylene and hexafluoropropylene), and other such materials in many different forms including but not limited to foamed, perforated, and composite structures.

EXAMPLE I

In order to demonstrate the improvement of the assembly of the present invention, the following test was performed. A 0.0559" O.D. silver plated copper conductor was wrapped with 0.042" of GORE-TEX insulation, an inner served foil shield was applied and then an outer braided shield; finally a 0.010" F.E.P. layer (available from E. I. DuPont de Nemours, Inc., Wilmington, Del.) is extruded over the braided shield.

Four 12" lengths of this coaxial cable were cut and to one end was attached a conventional straight SMA connector.

Four different types of connectors were attached to the other end of the 12" length:

Cable "A"—A second conventional straight SMA connector;

Cable "B"—A conventional box right angle adapter;

Cable "C"—A conventional mitered right angle adapter;

Cable "D"—The right angle connector according to the present invention.

These four samples were then tested on a Swept Frequency Measurement System available from the Weinschel Engineering Corporation. The properties measured were the insertion loss and Voltage Standing Wave Ratio (VSWR) at various frequencies. Table I shows the results of this experiment.

TABLE I

| | Insertion Loss (db) | | | |
|---|---|---|---|---|
| | SAMPLE | | | |
| FREQ. (GHz) | A | B | C | D |
| 2 | .15 | .20 | .16 | .15 |
| 3 | .20 | .26 | .22 | .20 |
| 4 | .20 | .28 | .24 | .22 |

TABLE I-continued

| | | | | |
|---|---|---|---|---|
| 5 | .25 | .30 | .30 | .26 |
| 6 | .28 | .33 | .31 | .30 |
| 7 | .30 | .40 | .35 | .31 |
| 8 | .31 | .40 | .38 | .32 |
| 9 | .33 | .45 | .45 | .35 |
| 10 | .35 | .45 | .45 | .36 |
| 11 | .35 | .50 | .51 | .38 |
| 12 | .40 | .48 | .51 | .40 |
| 13 | .40 | .48 | .50 | .45 |
| 14 | .41 | .50 | .60 | .43 |
| 15 | .42 | .49 | .81 | .50 |
| 16 | .45 | .68 | .92 | .50 |
| 17 | .50 | .74 | 1.05 | .50 |
| 18 | .53 | .70 | 1.10 | .55 |

| | VSWR | | | |
|---|---|---|---|---|
| | SAMPLE | | | |
| FREQ. (GHz) | A | B | C | D |
| 2 | 1.018 | 1.059 | 1.012 | 1.023 |
| 3 | 1.023 | 1.072 | 1.023 | 1.059 |
| 4 | 1.035 | 1.084 | 1.018 | 1.059 |
| 5 | 1.078 | 1.135 | 1.059 | 1.090 |
| 6 | 1.050 | 1.205 | 1.052 | 1.059 |
| 7 | 1.035 | 1.195 | 1.059 | 1.023 |
| 8 | 1.041 | 1.175 | 1.025 | 1.035 |
| 9 | 1.047 | 1.195 | 1.023 | 1.022 |
| 10 | 1.053 | 1.230 | 1.053 | 1.023 |
| 11 | 1.029 | 1.195 | 1.035 | 1.023 |
| 12 | 1.029 | 1.109 | 1.035 | 1.023 |
| 13 | 1.041 | 1.065 | 1.078 | 1.060 |
| 14 | 1.035 | 1.053 | 1.078 | 1.072 |
| 15 | 1.072 | 1.154 | 1.208 | 1.096 |
| 16 | 1.096 | 1.288 | 1.161 | 1.072 |
| 17 | 1.115 | 1.380 | 1.135 | 1.072 |
| 18 | 1.165 | 1.318 | 1.148 | 1.096 |

It is clear from Table I that the electrical properties of a coaxial assembly employing the teachings of the present invention performs almost as effectively as a straight connector and significantly better than the prior art adapters.

Although the present invention has been described and illustrated, neither the description nor the illustration is intended to be limiting as we intend to include under our invention any and all variation thereof which are ascertainable by one skilled in the art and covered by the claims.

We claim:

1. A connector for a coaxial cable for transmitting energy therethrough, the cable including a center conductor, an insulating medium, an outer cylindrical conductive shield and an outer jacket, the connector comprising: a tube having between its ends a bent portion said tube having a body and a cap, said body having a tubular cross-section at its mating end and said cap extending along at least a portion of said body, said body and said cap being separable for receiving therebetween a terminal portion of said center conductor, said insulating medium and said conductive shield; said body including electrically conductive means for forming an electrical connection with said conductive shield; and means for joining said cap to said body to form said tube after receipt of said terminal portion of said insulating medium and said conductive shield in said body.

2. A connector as recited in claim 1 in which the angle of said bent portion is about 90°.

3. A connector as recited in claim 1 in which the angle of said bent portion is greater than 90°.

4. A connector as recited in claim 1 in which the angle of said bent portion is less than 90°.

5. A connector as recited in claim 1 in which said joining means for said cap and said body is a tongue on said cap for insertion into a groove in said body.

6. A connector as recited in claim 1 in which said body is formed to provide a semi-circular trough that extends along the bent portion of the tube.

7. A connector as recited in claim 1 in which said cap has a semi-circular trough throughout its length.

8. A coaxial assembly for connecting a coaxial cable to an apparatus comprising: a coaxial cable having a center conductor, an insulating medium surrounding the conductor, a cylindrical outer conductive shield and an outer jacket; a tubular connector having between its ends a bent portion said tubular connector including a body and a cap, said body having a tubular cross-section at its mating end, said body and said cap being separable parts; the terminal portions of said center conductor, said insulating medium and said conductive cylindrical outer shield extending through said tubular connector, spanning said bent portion and terminating proximate said mating end; said tubular connector including electrically conductive means for connecting said cylindrical outer shield to said apparatus.

9. The coaxial assembly of claim 8 wherein said coaxial cable includes two or more cylindrical outer conductive shields, the terminal portions of said center conductor, said insulating medium and at least one said cylindrical outer conductive shield extending through said tubular connection; spanning said bent portion and terminating proximate said mating end; said tubular connector including electrically conductive means for connecting outermost cylindrical outer conductive shield to said apparatus.

10. The coaxial assembly of claim 8 in which said tubular connector is conductive.

11. The coaxial assembly of claim 8 in which said tubular connector is plated with a coating of high electrical conductivity.

12. The coaxial assembly of claim 8 in which the angle of said bent portion is about 90°.

13. The coaxial assembly of claim 8 in which the angle of said bent portion is greater than 90°.

14. The coaxial assembly of claim 8 in which the angle of said bent portion is less than 90°.

15. The coaxial assembly of claim 8 in which said body is formed to provide a semi-circular trough that extends along the bent portion of the tube.

16. The coaxial assembly of claim 8 in which said cap has a semi-circular trough throughout its length.

17. The coaxial assembly of claim 8 in which said insulating medium is expanded polytetrafluoroethylene.

* * * * *